US005797149A

United States Patent [19]

Mustarde

[11] Patent Number: 5,797,149

[45] Date of Patent: Aug. 25, 1998

[54] BATH LIFT

[76] Inventor: John Clarke Mustarde, 90 Longhill Avenue, Ayr, Ayrshire, KA7 4DF, Great Britain

[21] Appl. No.: 603,518

[22] Filed: Feb. 20, 1996

Related U.S. Application Data

[63] Continuation of Ser. No. 240,688, filed as PCT/GB92/02084, Aug. 29, 1994, published as WO93/09748, May 27, 1993, abandoned.

[30] Foreign Application Priority Data

Nov. 15, 1991 [GB] United Kingdom ..... 9124327
Jun. 20, 1992 [GB] United Kingdom ..... 9213149

[51] Int. Cl.[6] ..... A47K 3/02

[52] U.S. Cl. ..... 4/566.1; 4/560.1

[58] Field of Search ..... 4/560.1, 561.1, 4/562.1, 563.1, 564.1, 565.1, 566.1

[56] References Cited

U.S. PATENT DOCUMENTS

| | | | |
|---|---|---|---|
| 2,725,578 | 12/1955 | Keller | 4/565.1 |
| 2,772,721 | 12/1956 | Saunders | 4/560.1 X |
| 3,091,778 | 6/1963 | Gross | 4/566.1 |
| 3,123,400 | 3/1964 | Paulson | 4/560.1 X |
| 3,311,930 | 4/1967 | Bourke | 4/566.1 |
| 3,624,666 | 11/1971 | Higgins, Sr. | 4/562.1 |
| 4,768,239 | 9/1988 | Pauley | 4/564.1 |
| 5,157,797 | 10/1992 | Forwick | 4/566.1 |

FOREIGN PATENT DOCUMENTS

| | | | |
|---|---|---|---|
| 0074460 | 3/1983 | European Pat. Off. . | |
| 0347652 | 12/1989 | European Pat. Off. . | |
| 8914682 | 3/1990 | Germany . | |
| 2110527 | 6/1983 | United Kingdom | 4/561.1 |
| 8807848 | 10/1988 | WIPO . | |

*Primary Examiner*—Robert M. Fetsuga
*Attorney, Agent, or Firm*—Frank J. Dykas

[57] ABSTRACT

A bath lift having a lower portion frame extending upwardly and rearwardly from a bathtub floor pivotally connected to an upper frame. The upper frame is provided with a pivotally mounted seat. A fluid actuated piston is interconnected between the upper and lower frames to raise and lower the upper frame and seat. Fluid for actuating the piston is provided by a control valve system utilizing a domestic pressurized cold water supply or a hand or foot pump system.

12 Claims, 4 Drawing Sheets

BATH LIFT

This application is a continuation of application Ser. No. 08/240,688, filed as PCT/GB92/02084 Aug. 29, 1994 published as WO93/09748 May 27, 1993, abandoned.

This invention relates to improvements in bath lifts and in particular to bath lifts for assisting ingress and egress from a bath.

Many elderly and disabled persons require assistance in bathing and various lifts and hoists have been developed to help a person to get into and get out of a bath. These hoists and lifts include supporting frameworks which may be located outside or inside the bath and which support seats which may be lowered from an entry position, where the seat is at least level with the rim of the bath, to a bathing position, where the seat is located as close as possible to the floor of the bath. A number of the lifts currently available are manually operated by, for example, turning a handle, though the operation of such lifts can prove tiring for may persons, particularly when they are in a seated position. Other lifts are provided with hydraulic lift arrangements operated by motor driven pumps, however these tend to be relatively expensive and complex. A number of lifts, such as the Tubmate Bath Lift available from Asgo Ltd, are powered by water pressure, available from the domestic cold water supply. The Tubmate Bath Lift includes a frame which is attached to the bath floor by means of four large suction pads and which includes a vertical mast on which the seat is mounted. However, the Tubmate Lift is relatively heavy and can prove awkward to remove to permit an able bodied person to use the bath, and installation requires the services of a plumber.

Water pressure is also used to lift the bather in the Tamplin Lifting Bath Cushion, available from Davis Tamplin, which is simply a cushion which may be filled to lift the bather from the floor of the bath, though the cushion only rises to within 80 mm of the bath rim and thus does not assist in entry and exit from the bath.

It is one of the objects of the present invention to provide a bath lift which is of lightweight construction and thus can be removed from and fitted to a bath without difficulty.

It is a further object of the present invention to provide a bath lift which may operate using water pressure supplied from a domestic water supply system and which may be readily connected to the system.

It is a still further object of the present invention to provide a bath lift which facilitates ingress and egress from a bath.

These objects are achieved by providing bath lift apparatus which utilises a collapsible fluid actuated piston connected to the domestic cold water supply to lift a seat from adjacent the floor of the bath to adjacent the rim of the bath. Deflation of the piston provides for controlled descent of the seat from the raised position. The seat and piston are mounted in a lightweight frame which sits on the floor of the bath and which may be readily removed from the bath, if required. Control of the bath lift is achieved by control valves which may be operated by taps or levers mounted on the bath rim within easy reach of the bather.

According to one aspect of the present invention there is provided bath lift apparatus for assisting ingress and egress from a bath, the apparatus comprising:

a frame having a lower portion including a bath floor engaging part and extending upwardly and rearwardly therefrom to a pivotal connection with an upper frame portion;

a seat pivotally mounted to the upper frame portion;

a fluid actuated lifting means located between the lower frame portion and the seat;

conduit means for connecting the lifting means to a pressurised fluid source; and control means for controlling the supply of pressurised fluid to the lifting means to permit inflation thereof to lift the seat and to permit deflation thereof to lower the seat.

The frame configuration permits the rear part of the lower frame portion may thus extend into the sloping rear portion of the bath. This allows the arc described by the pivoting upper stabilising frame portion to be relatively large to minimise longitudinal translation of the seat during raising and lowering without compromising the space available in the bath.

In use, the frame configuration acts to stabilise the seat against unwanted movement as the seat is raised and lowered. The apparatus is conveniently arranged to allow the lifting means to be connected permanently or temporarily to a domestic cold water supply system or to a hand or foot pump system. Preferably, means are provided for releasably connecting the apparatus to an adjacent cold water tap. The water pressure may thus be used to inflate the lifting means and raise the seat, conveniently to a height level with the top of the bath. The bather may then slide over the rim of the bath onto the seat and operate the control means to deflate the lifting means, which conveniently drains into an adjacent wash hand basin or w.c. The water draining from the lifting means thus does not cool the bath water. With the seat in the lowered position the bather may remain on the seat. To leave the bath the bather operates the control means to inflate the lifting means and lift the seat to the raised position, from where the bather may slide from the seat over the rim of the bath.

Preferably, the lifting means is in the form of a collapsible, inextensible fluid actuated piston.

The fluid piston may itself be formed of inextensible material or may be located within a non-extensible outer jacket. The piston may be contained within a retaining system of collapsible rings, a coiled spring or a similar device formed of segments of rigid material.

The use of a collapsible, inextensible piston allows the piston to be located between the seat and the lower frame portion, directly beneath the seat, while allowing the seat to be lowered to a position only a short distance above the floor of the bath. This allows the user to bathe without having to use a significant extra volume of water and provides a very compact arrangement. The piston may include reinforcing hoops and preferably the hoops are concentric and have stepped diameters such that, in the collapsed configuration, the hoops fit within one another.

The seat is preferably hingedly connected to the upper frame portion towards the front of the apparatus. Most preferably, a secondary stabilising frame is provided between the seat and the forward part of the lower frame portion and is arranged to maintain the seat horizontal as it is raised and lowered. The secondary stabilising frame may be in the form of a "Y" having a first frame member pivotally connected between the seat and lower frame portion and a second frame member having one end pivotally connected to an intermediate portion of the first frame member and the other end pivotally connected to the seat. The upper end of the first frame member is preferably slidably mounted in a horizontal track extending along a side of the seat. Most preferably, a secondary stabilising frame is provided on each side of the apparatus. Alternatively, a secondary stabilising frame may be provided between the rear of the first stabilising frame and the seat and serves to maintain the seat horizontal as it is raised and lowered. Further, the seat is preferably slidably mounted on a seat frame pivotally mounted to the front of the upper portion of the frame and the secondary stabilising frame is arranged to hold the seat to follow a vertical path as the upper portion of the frame pivots on the lower portion of the frame with minimal forwards and rearwards motion, which some user's can find disconcerting.

The control means may include valves for controlling fluid flow to and from the lifting means. The valves may be operated by conventional taps or using a suitable lever or other control. The valve operators are conveniently located in a module arranged for mounting on the rim of the bath within easy reach of the bather.

Preferably, the apparatus includes a valve for closing the supply of pressurised water to the lifting means when the seat reaches a predetermined but adjustable fully raised position.

Side flaps may be pivotably attached to the seat, which flaps extend over the bath rim when the seat is raised and then pivot upwardly as the seat is lowered to hold the user on the seat and to prevent the user's fingers from being caught between the seat and frame portions.

These and other aspects of the present invention will now be described, by way of example, with reference to the accompanying drawings, in which.

Figure 1:
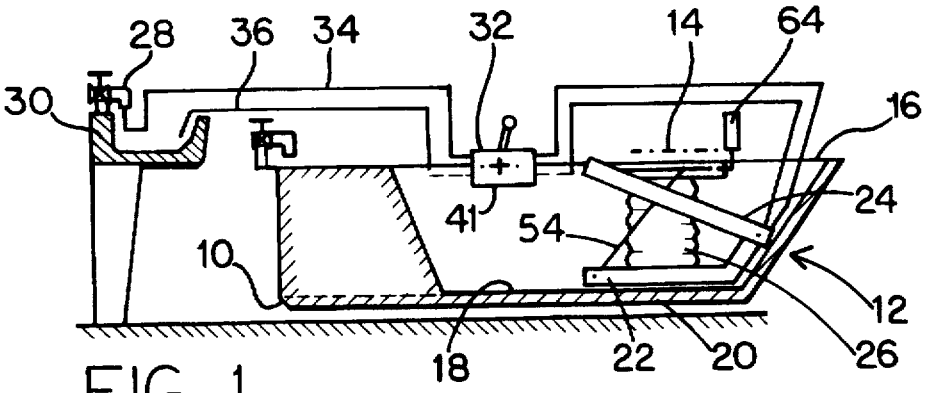
FIG. 1 is a part-sectional side view of a bath lift apparatus in accordance with a preferred embodiment of the present invention, shown fitted in a bathroom.

Reference is first made FIG. 1 of the drawings which shows, partially cut away, a bath 10 provided with a bath lift 12 in accordance with a preferred embodiment of the present invention. The bath lift 12 sits towards the sloping end of the bath, normally at the opposite end from the taps and drain, and is used to assist in ingress and egress of an elderly or disabled person from the bath. The lift 12 includes a seat 14 and this is shown in the raised position in FIG. 1, in which the seat 14 is substantially level with the rim 16 of the bath. As will be described, the lift 12 may be operated to lower the seat 14 to a position adjacent the bath floor 18 and to lift the seat 14, and the bather, back to the raised position, facilitating exit from the bath.

The lift 12 includes a frame 20 having a lower portion 22 which sits on the bath floor 18 and an upper portion 24 to which the seat 14 is pivotally mounted. A collapsible inextensible fluid piston in the form of a water jacket 26 provided as a fluid actuated lifting means is located between the lower frame portion 22 and the seat 14. As will be described, the water jacket 26 may be inflated using tap water, to lift the seat.

In the embodiment illustrated, the water jacket 26 is temporarily connected to the cold water tap 28 of an adjacent wash hand basin 30. By means of a control means 32, which includes appropriate valves operably connected to conduit means, as will be described, the bather may allow water to flow through an inlet conduit 34 to the water jacket 26. As the jacket 26 reaches full inflation and the seat 14 reaches the fully raised position, the flow of water from the tap 28 is automatically cut off. To deflate the water jacket 26, the control 32 is operated to allow water to drain from the jacket 26 through a drain conduit 36 into the wash hand basin 30.

Figure 3:
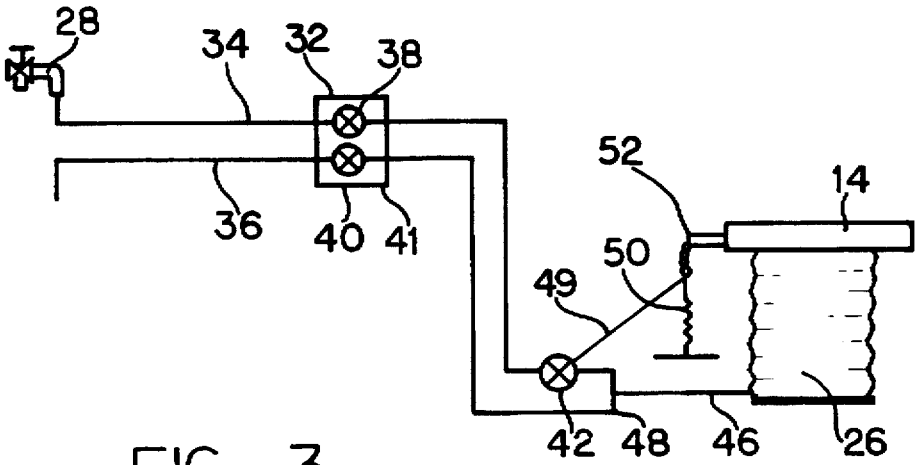
FIG. 3 is a diagrammatic representation of the means for lowering and raising the apparatus of FIG. 1.

The water jacket supply system is illustrated diagrammatically in FIG. 3 of the drawings and this illustrates the automatic shut-off. The Figure shows the jacket 26 fully inflated with the seat 14 in the raised position. Three valves are shown, an inlet valve 38, a drain valve 40 and a shut-off valve 42. The inlet and drain valves 38, 40 are located in the control 32 on the respective conduit 34, 36 and the shut-off valve 42 is located on the inlet conduit 34. Both conduits communicate with the water jacket 26 via a single conduit 46 which is connected through a suitable T-joint 48 to the conduits 34, 36.

To raise the seat 14 and inflate the water jacket 26 the inlet valve 38 is opened while the drain valve 40 is closed. The shut-off valve 42 is opened and closed by means of a lever 49 which is normally biased to the open position by a spring 50. However, when the water jacket 26 is inflated and the seat 14 is raised a limit connection 52 which extends between the seat 14 and the end of the lever 49 closes the valve 42.

To deflate the water jacket 26 and thus lower the seat 14, the inlet valve 38 is closed while the drain valve 40 is opened. Thus, water may flow through the drain conduit 36. As the seat 14 moves downwardly, under the weight of the bather, the spring 50 returns the shut-off valve operating lever 49 to its normal position and opens the shut-off valve 42.

The inlet and drain valves 38, 40 are provided in a module 41 adapted to be fitted over the rim of the bath within easy reach of the operator. The valves 38, 40 may be operated by conventional taps or by means of a lever as shown.

The lift is also provided with a pressure regulator (not shown) which allows the release of water from the system if the water pressure rises above a predetermined safe level.

Figure 10:
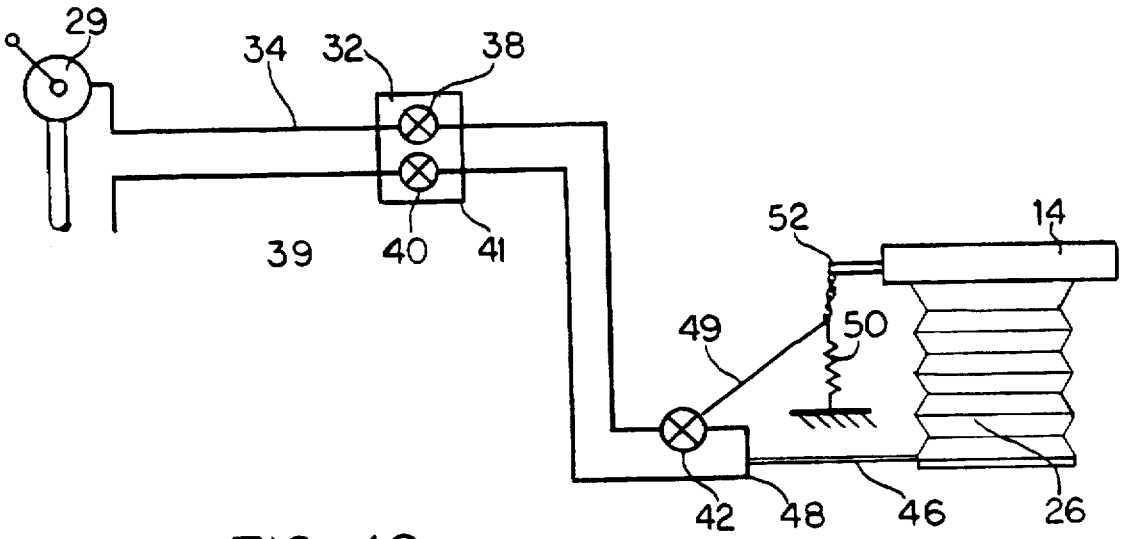
FIG. 10 is a diagrammatic representation of the means for lowering and raising the apparatus of FIG. 1 using a pump as a source of pressurized fluid.

As an alternative, or as a supplement to pressurized tap water, pump means 29 as shown in FIG. 10, may be provided as a source of pressurized water for extension of water jacket 26. Pump means 29 may be either a hand operated pump, or an electrically powered pump.

The configuration of the frame 20 of the lift will now be described. The upper and lower frame portions 22, 24 are pivotally connected towards the back of the lift while the seat 14 is pivotally connected to the upper frame portion 24 towards the front of the lift. A further, stabilising frame 54 is provided between the seat 14 and the lower frame portion 22 and is arranged to maintain the seat 14 horizontal as it is raised and lowered, as will be described.

Figure 4:
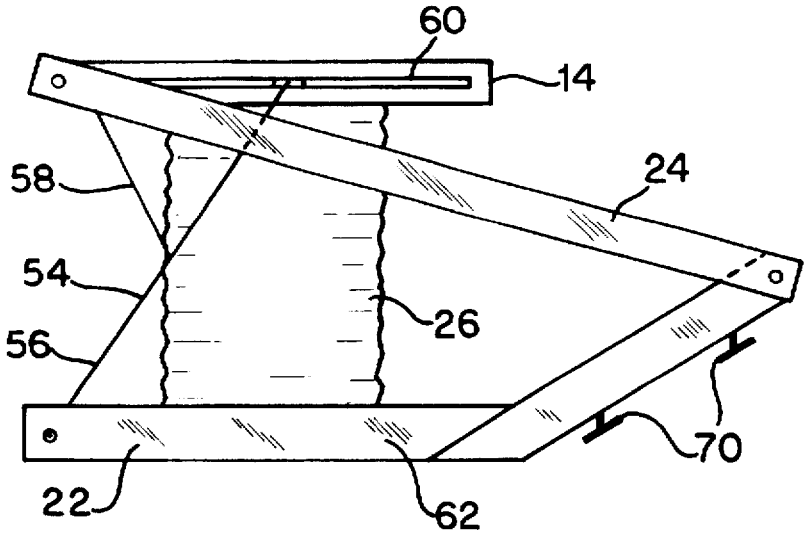
FIGS. 4, 5 and 6 are side views of frame elements of the bath lift apparatus of FIG. 1 shown in the fully raised, partially raised, and fully lowered positions, respectively.
Figure 5:
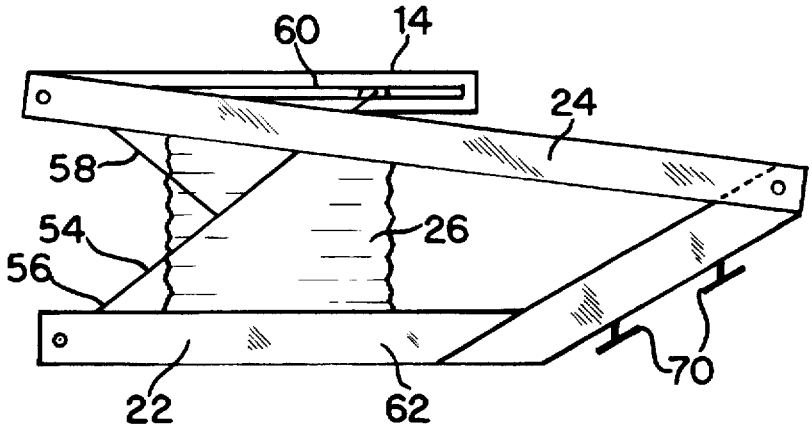
Figure 6:
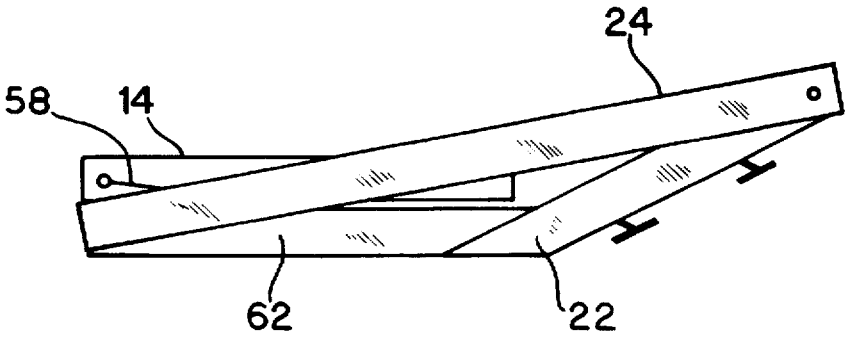

Reference is now also made to FIGS. 4 through 6 of the drawings which illustrate the various frame portions and the seat. The frame portions are of similar configuration on both sides of the lift and will be described with reference to only one side of the lift. It may be seen that the stabilising frame 54 is in the form of a "Y" and has a first frame member 56 pivotally connected between the seat 14 and the front end of the lower frame portion 22. The frame 54 further includes a second frame member 58 having its lower end pivotally connected to an intermediate portion of the first frame member 56 and its other end is pivotally connected to the front end of the seat 14. To maintain the seat 14 parallel as it is raised and lowered, the upper end of the first frame member 56 is mounted on a horizontal slide track 60 provided in a side portion of the seat 14.

The lower frame portion 22 extends upwardly and rearwardly from a planar floor engaging part 62 to the pivotal connection between the frame portions 22, 24. The rear part of the lower frame portion 22 may thus extend into the sloping rear portion of the bath. This allows the upper frame portion 24 to be relatively long such that the arc described by the pivoting upper frame portion 24 is relatively large and thus minimises longitudinal translation of the seat 14 during raising and lowering, without comprising the space available in the bath. In practice, it has been found that the translation is typically no more than 2.5 cm (1 inch), which is practically unnoticed by the bather. It will also be noted that the bath floor engaging part 62 of the lower frame portion fits within the upper frame portion (see FIG. 6) to permit the seat to be lowered almost to the bath floor.

The jacket 26 is formed of inextensible material, such as fibre reinforced PVC and for additional strength, as well as to minimise lateral sagging or distortion in states other than the completely full state, may be contained within a retaining system formed of a plurality of collapsible rings. At its lower end, the jacket 26 is mounted on a part of the lower frame portion 22 which extends between the frame side members and the upper end of the jacket is connected to the base of the seat 14.

FIG. 1 illustrates the lift 12 with the seat 14 provided with a back rest 64. If the bather wishes to lie in the bath, with the bath lift 12 in the lower position, the back rest 64 may be removed. For the comfort of the bather, a back support 66 (FIG. 2) in the form of a sloping plate is provided between the rear ends of the side members of the upper portion 24. In the reclined position the bather may find it easier to wash their upper body and also their perineum.

Suction pads 70 are provided on the inclined portions of the side members of the lower frame portion 22 for attaching to the sloping end of the bath 10. This provides additional stability for the lift 12 while not substantially increasing the difficulty of removing the lift 12 from the bath 10 when the bath 10 is to be used by an able bodied person.

Figure 2:
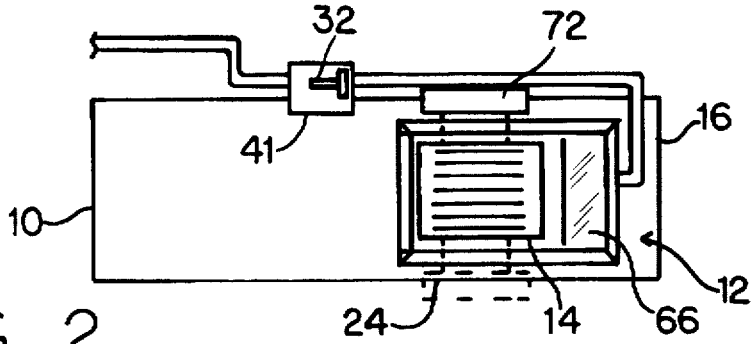
FIG. 2 is a plan view of the bath lift apparatus and bath of FIG. 1.

FIG. 2 shows a seat extension 72 which is removably mounted to the seat 14 to facilitate sliding on to and from the seat 14 over the rim 16 over the bath. Alternatively, the extension 72 may be mounted to the bath and remain in place as the seat 14 is lowered.

The bath lift 12 may be manufactured in any suitable, water resistant materials, the frames 20,24 and at least the frame of the seat 14 being manufactured from a lightweight, rigid material such as a rigid plastic, while the stabilising frame 54 may be manufactured in stainless steel. The seat 14, back support 66 and seat extension 72 may be provided with padding for greater comfort.

As will be clear from the above description, the bath lift 12 allows an elderly or disabled person to raise and lower themselves from the bath with minimal effort. The lift configuration allows the lift to be of compact and lightweight construction so that it may be easily removed from the bath, while providing stability when in use. Also, the bath lift configuration allows the seat to be lowered to within around 5 cm (2 inches) of the bath floor such that it is not necessary to fill the bath very much higher than is normally required.

Figure 7:
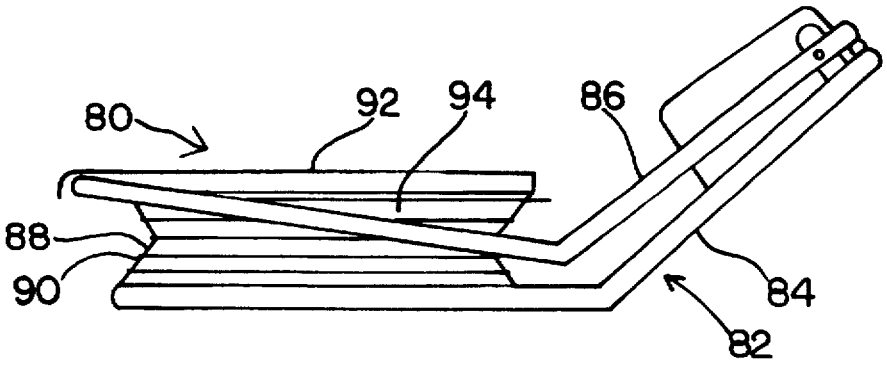
FIG. 7 is a side view of a bath lift apparatus in accordance with a further embodiment of the present invention, shown in the lowered position.
Figure 8:
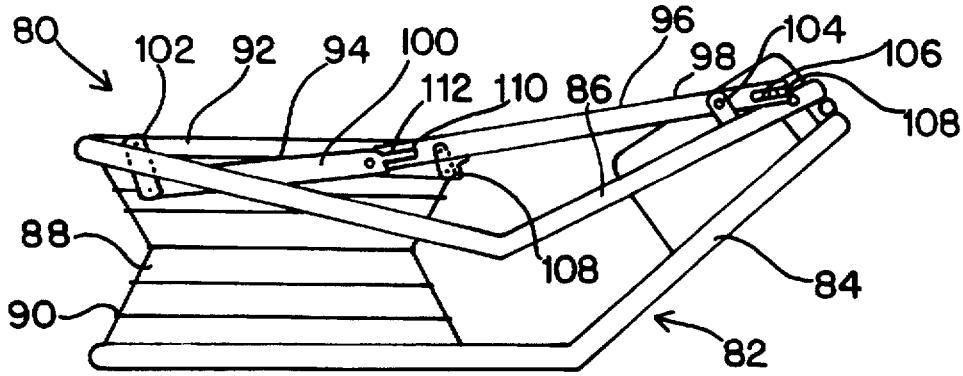
FIG. 8 is a side view of the bath lift apparatus of FIG. 7, in the raised position and showing a secondary stabilising frame.
Figure 9:
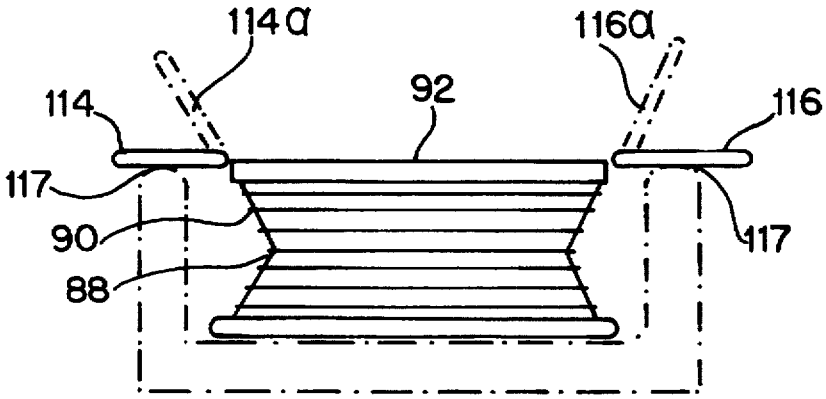
FIG. 9 is a front view of the bath lift apparatus of FIG. 7 with side flaps also shown.

Reference is now made to FIGS. 7, 8 and 9 of the drawings which shows a bath lift 80 in accordance with a further embodiment of the present invention. The bath lift 80 operates in a similar manner to the first embodiment described above and therefore only different features will be described in any detail. The lift includes a frame 82 having pivotally connected lower and upper portions 84, 86, both portions being of similar form to simplify manufacture. The portions 84, 86 in this example are of welded stainless steel tubing, but for lightness in weight they would preferably be made in rigid moulded plastic.

The water jacket 88 is formed of a flexible jacket provided with a plurality of strengthening hoops 90. In this example the hoops 90 are rectangular and vary in diameter from a minimum at the middle of the jacket to a maximum at the seat 92 and the lower portion of the frame 84, to provide a water jacket in the form of two truncated square pyramids. The hoops are sized such that, when the water jacket is deflated, the hoops fit within one another thus limiting the height occupied by the deflated jacket as best seen in FIG. 7: and are at distance from each other to restrict lateral sway and sagging when not inflated fully. A convenient distance would be 2.5 cm or less.

The seat 92 is slidably mounted on a seat frame 94 which is itself pivotally mounted to the front of the upper portion of the frame 86. A secondary stabilising frame 96 (FIG. 8) is provided on the side of the lift and connects the seat and seat frame 92, 94 with the frame 82. The frame 96 includes three pivotally interconnected links 98, 100, 102. The link 98 is pivotally connected to the upper portion of the frame 86 at a bracket 104 but also includes a slot 106 which engages a pin 108 mounted to the lower portion of the frame 84. The other end of the link 98 is also slotted at 110 and receives a pin 112 extending from the side of the seat frame 94. The end of the link 98 is pivotally connected to the link 100 which is in turn pivotally connected to the link 102, the other end of the link 102 being pivotally connected to the seat 92. The link 102 is also pivotally connected to the seat frame 94, and a second link 103 provides a pivotal connection between the rear of the seat and seat frame 92, 94.

The links are configured to move the seat in the horizontal plane to describe a substantially vertical path as the seat is raised and lowered of the upper portion of the frame 86, which describes an arc as it is raised and lowered. In use, the seat 92 is initially moved rearwards on the seat frame 94 as the seat is raised from the lowered position until the forward end of the upper portion of the frame 86 is raised above the pivot point between the frame portions 84, 86, after which the seat 92 is moved forwards on the seat frame 94.

FIG. 9 illustrates the seat 92 provided with a pair of hinged side flaps 114, 116 which lie between the seat and the respective bath rim 117 when the seat is raised and are then pivoted to the positions 114*a*, 116*a* shown in broken outline in the figure as the seat is lowered. The flaps 114, 116 assist the user in moving onto and from the seat and also assist in maintaining the user on the seat as it is lowered. The flaps 114, 116 also prevent the user from holding onto the sides of the seat and to minimise the risk of their fingers being caught in the frame.

It will be obvious to those of skill in the art that the above described embodiment is merely exemplary of the present invention, and that various modifications and improvements may be made to the illustrated embodiment without departing from the scope of the invention; if the rim mounted module containing the control valves 38, 40 is inconvenient for a particular bather, the module may be provided with suction pads for mounting on a side wall of the bath or on a wall of the bathroom; and rather than using the cold water supply pressure to raise the seat, a hand, foot or powered pump system may be provided.

I claim:

1. Bath lift apparatus for assisting ingress and egress from a bath, the apparatus comprising:

a frame having a lower frame portion and an upper frame portion, the lower frame portion including a bath floor engaging first part rigidly fixed to a second part extending upwardly and rearwardly from a rear portion of said first part to a pivotal connection with said upper frame portion, said connection being at a fixed elevation, said upper frame portion extending forwardly from said connection;

a seat pivotally mounted to a front part of the upper frame portion;

a fluid actuated lifting means located between the lower frame portion and the seat for lifting the seat from a bathing position to a raised position, said connection remaining at said elevation during seat movement between said bathing and raised positions;

conduit means for connecting the lifting means to a pressurised fluid source; and control means operatively connected to said lifting means for controlling the supply of pressurised fluid to the lifting means to permit inflation thereof to lift the seat and to permit deflation thereof to lower the seat.

2. Bath lift apparatus as claimed in claim 1, wherein the lifting means is in the form of a collapsible, inextensible fluid actuated piston.

3. Bath lift apparatus as claimed in claim 1, wherein the pressurized fluid source is a pump.

4. Bath lift apparatus as claimed in claim 1, wherein the conduit means drains into an adjacent wash hand basin or w.c. on deflation of the lifting means.

5. Bath lift apparatus as claimed in claim 1 further including a secondary frame for maintaining the seat horizontal as it is raised and lowered.

6. Bath lift apparatus as claimed in claim 5, wherein the secondary frame is provided between the seat and the first part of the lower frame portion.

7. Bath lift apparatus as claimed in claim 5, wherein the secondary frame is provided between a rear part of the frame and the seat.

8. Bath lift apparatus as claimed in claim 7, wherein the seat is slidably mounted on a seat frame itself pivotally mounted to the front of the upper portion of the frame and the secondary frame is arranged to hold the seat to follow a substantially vertical path as the upper portion of the frame pivots on the lower portion of the frame.

9. Bath lift apparatus as claimed in claim 1 wherein the control means includes a valve for controlling flow to and from the lifting means.

10. Bath lift apparatus as claimed in claim 11, wherein the valve is located in a module for mounting on the rim of the bath.

11. Bath lift apparatus as claimed in claim 1, including a valve for closing the supply of fluid to the lifting means when the seat reaches a predetermined fully raised position.

12. Bath lift apparatus as claimed in claim 1 including side flaps pivotably attached to the seat, which flaps extend over the bath rim when the seat is raised and then pivot upwardly as the seat is lowered to hold the user on the seat and prevent the user's fingers from being caught between the seat and frame portions.

* * * * *